US011783797B2

(12) United States Patent
Hyun et al.

(10) Patent No.: US 11,783,797 B2
(45) Date of Patent: Oct. 10, 2023

(54) DISPLAY APPARATUS AND METHOD OF DRIVING THE SAME

(71) Applicant: Samsung Display Co., LTD., Yongin-si (KR)

(72) Inventors: Chang Ho Hyun, Seoul (KR); Seungwon Chegal, Suwon-si (KR); Eunjeong Cho, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/860,000

(22) Filed: Jul. 7, 2022

(65) Prior Publication Data

US 2023/0012198 A1 Jan. 12, 2023

(30) Foreign Application Priority Data

Jul. 8, 2021 (KR) ..... 10-2021-0089711

(51) Int. Cl.
*G09G 5/10* (2006.01)

(52) U.S. Cl.
CPC ..... *G09G 5/10* (2013.01); *G09G 2360/141* (2013.01); *G09G 2360/145* (2013.01); *G09G 2360/16* (2013.01)

(58) Field of Classification Search
CPC ..... G09G 5/10; G09G 2360/141; G09G 2360/145; G09G 2360/16
See application file for complete search history.

(56) References Cited

U.S. PATENT DOCUMENTS

| | | | | |
|---|---|---|---|---|
| 2019/0196635 | A1* | 6/2019 | Park | G06F 3/14 |
| 2019/0353520 | A1* | 11/2019 | Li | G09G 3/20 |
| 2020/0099836 | A1* | 3/2020 | Chao | G02B 7/02 |
| 2020/0152724 | A1* | 5/2020 | Cho | G06F 3/0412 |
| 2020/0204715 | A1* | 6/2020 | Ouyang | H01L 27/3234 |
| 2021/0125578 | A1* | 4/2021 | Liu | G09G 3/20 |

FOREIGN PATENT DOCUMENTS

| | | | |
|---|---|---|---|
| KR | 10-1784216 | B1 | 10/2017 |
| KR | 10-2018-0062585 | A | 6/2018 |
| KR | 10-2020-0079868 | A | 7/2020 |

* cited by examiner

*Primary Examiner* — Antonio Xavier
(74) *Attorney, Agent, or Firm* — Lewis Roca Rothgerber Christie LLP

(57) ABSTRACT

A display apparatus includes: a display panel comprising a first area having a first pixel structure and a second area having a second pixel structure different from the first pixel structure; a camera under the display panel and corresponding to the second area of the display panel; and a luminance compensator configured to determine a luminance of the first area and a luminance of the second area using captured data captured by the camera and configured to compensate image data applied to the display panel.

20 Claims, 14 Drawing Sheets

| | LN | LU |
|---|---|---|
| G1 | LN1 | LU1 |
| G11 | LN11 | LU11 |
| G23 | LN23 | LU23 |
| G35 | LN35 | LU35 |
| G51 | LN51 | LU51 |
| G87 | LN87 | LU87 |
| G151 | LN151 | LU151 |
| G203 | LN203 | LU203 |
| G255 | LN255 | LU255 |
| ⋮ | | |
| G350 | | LUMAX |

DISPLAY APPARATUS AND METHOD OF DRIVING THE SAME

CROSS-REFERENCE TO RELATED APPLICATION

The present application claims priority to and the benefit of Korean Patent Application No. 10-2021-0089711, filed on Jul. 8, 2021 in the Korean Intellectual Property Office KIPO, the entire content of which is incorporated herein by reference.

BACKGROUND

1. Field

Aspects of some embodiments of the present disclosure relate to a display apparatus and a method of driving the display apparatus.

2. Description of the Related Art

Generally, a display apparatus includes a display panel and a display panel driver. The display panel includes a plurality of gate lines, a plurality of data lines and a plurality of pixels. The display panel driver includes a gate driver, a data driver and a driving controller. The gate driver outputs gate signals to the gate lines. The data driver outputs data voltages to the data lines. The driving controller controls the gate driver and the data driver.

The display apparatus may further include a camera or a sensor to operate an additional function. When the camera or the sensor is located under the display panel, a transmission area may be formed in the display panel for an operation of the camera or an operation of the sensor so that the luminance ununiformity of the image on the display panel may be generated due to the transmission area.

The above information disclosed in this Background section is only for enhancement of understanding of the background and therefore the information discussed in this Background section does not necessarily constitute prior art.

SUMMARY

Aspects of some embodiments of the present disclosure relate to a display apparatus and a method of driving the display apparatus. For example, some embodiments of the present disclosure relate to a display apparatus configured to compensate a luminance difference between a normal area of a display panel where the camera (or the sensor) is not located and a camera area (or a sensor area) of the display panel where the camera (or the sensor) is located using data obtained by a camera (or a sensor) located in the display apparatus and a method of driving the display apparatus.

Aspects of some embodiments according to the present disclosure include a data apparatus compensating a luminance ununiformity of a display panel using data obtained by a camera (or a sensor) located in the display apparatus.

Aspects of some embodiments according to the present disclosure include a method of driving the display apparatus.

Aspects of some embodiments according to the present disclosure include, a display apparatus includes a display panel, a camera and a luminance compensator. The display panel includes a first area having a first pixel structure and a second area having a second pixel structure different from the first pixel structure. The camera is located under the display panel and corresponding to the second area of the display panel. The luminance compensator is configured to determine a luminance of the first area and a luminance of the second area using captured data captured by the camera and configured to compensate image data applied to the display panel.

According to some embodiments, a protect layer may be located on a surface of the display panel. The surface of the display panel may include a screen hole where the protect layer does not correspond to the second area.

According to some embodiments, a size of the screen hole may be greater than a size of the second area.

According to some embodiments, the camera may be configured to capture an inner area of the screen hole from the surface of the display panel.

According to some embodiments, the camera may be configured to obtain the captured data by capturing an image displayed in a compensation display area surrounding the second area. The compensation display area may include all of the second area and a portion of the first area. The camera may be configured to obtain first captured data when a black image is displayed in the entire compensation display area. The camera may be configured to obtain second captured data when the black image is displayed in the first area of the compensation display area and a white image is displayed in the second area of the compensation display area. The luminance compensator may be configured to determine the luminance of the second area by subtracting the first captured data from the second captured data.

According to some embodiments, when a luminance of the first captured data is LUM1, a luminance of the second captured data is LUM2, the second area has a circular shape and a radius of the second area is r, a luminance of a unit area of the second area may be $(LUM2-LUM1)/\pi r^2$.

According to some embodiments, the camera may be configured to obtain third captured data when the white image is displayed in the first area of the compensation display area and the white image is displayed in the second area of the compensation display area. The luminance compensator may be configured to determine the luminance of the first area by subtracting the second captured data from the third captured data.

According to some embodiments, when a luminance of the second captured data is LUM2, a luminance of the third captured data is LUM3, the compensation display area has a circular shape, a radius of the compensation display area is R, the second area has a circular shape and a radius of the second area is r, a luminance of a unit area of the first area may be $(LUM3-LUM2)/\pi(R^2-r^2)$.

According to some embodiments, a size of the compensation display area may be substantially the same as a size of the screen hole.

According to some embodiments, a size of the compensation display area may be less than a size of the screen hole and greater than a size of the second area.

According to some embodiments, the luminance compensator may be configured to receive first grayscale data corresponding to the second area and configured to compensate the first grayscale data to second grayscale data such that the luminance of the second area becomes substantially the same as the luminance of the first area.

According to some embodiments, the luminance compensator may be configured to measure LN which is a luminance for each grayscale value of the first area and LUMAX which is a maximum luminance of the second area and configured to determine a grayscale value GMAX corresponding to the LUMAX based on a reference of the first area. When the luminance of the first area for a grayscale value X is a LNX, the second grayscale data for the grayscale value X is GX and a gamma value of the display panel is γ, $GX=GMAX(LNX/LUMAX)^{1/\gamma}$ may be satisfied.

According to some embodiments, the luminance compensator may be configured to receive first grayscale data corresponding to the first area and configured to compensate the first grayscale data to second grayscale data such that the luminance of the first area becomes substantially the same as the luminance of the second area.

According to some embodiments, a pixel density of the first pixel structure may be greater than a pixel density of the second pixel structure.

According to some embodiments, the first pixel structure may include four pixels arranged in two rows and two columns. The second pixel structure may include three pixels and one transmission window arranged in two rows and two columns.

According to some embodiments, the first pixel structure may include four pixels arranged in two rows and two columns. The second pixel structure may include two pixels and two transmission windows arranged in two rows and two columns.

According to some embodiments, a display apparatus includes a display panel, a photo sensor and a luminance compensator. The display panel includes a first area having a first pixel structure and a second area having a second pixel structure different from the first pixel structure. The photo sensor is arranged under the display panel and corresponding to the second area of the display panel. The luminance compensator is configured to determine a luminance of the first area and a luminance of the second area using light amount data of the display panel sensed by the photo sensor and configured to compensate image data applied to the display panel.

According to some embodiments, in a method of driving a display apparatus, the method includes: determining a luminance of a second area of a display panel, the display panel comprising a first area having a first pixel structure and the second area having a second pixel structure different from the first pixel structure, using a camera located under the display panel and corresponding to the second area, determining a luminance of the first area using the camera and compensating image data applied to the display panel based on the luminance of the first area and the luminance of the second area.

According to some embodiments, the camera may be configured to obtain the captured data by capturing an image displayed in a compensation display area surrounding the second area. The compensation display area may include all of the second area and a portion of the first area. The camera may be configured to obtain first captured data when a black image is displayed in the entire compensation display area. The camera may be configured to obtain second captured data when the black image is displayed in the first area of the compensation display area and a white image is displayed in the second area of the compensation display area. The luminance compensator may be configured to determine the luminance of the second area by subtracting the first captured data from the second captured data.

According to some embodiments, the camera may be configured to obtain third captured data when the white image is displayed in the first area of the compensation display area and the white image is displayed in the second area of the compensation display area. The luminance compensator may be configured to determine the luminance of the first area by subtracting the second captured data from the third captured data.

According to the display apparatus and the method of driving the display apparatus, the luminance difference between the normal area of the display panel where the camera (or the sensor) is not arranged and the camera area (or the sensor area) of the display panel where the camera (or the sensor) is arranged may be compensated using the data obtained by the camera (or the sensor) arranged in the display apparatus.

When the luminance difference of the display panel is compensated using the built-in camera (or the built-in sensor), the luminance difference of the display panel may be compensated in real time (e.g. during a power-on period or a power-off period) without an additional compensation device. Thus, the display quality of the display apparatus may be enhanced.

BRIEF DESCRIPTION OF THE DRAWINGS

The above and other features and characteristics of embodiments according to the present disclosure will become more apparent by describing in more detail aspects of some embodiments thereof with reference to the accompanying drawings, in which.

DETAILED DESCRIPTION

Hereinafter, further details of some embodiments of the present disclosure will be described in more detail with reference to the accompanying drawings.

Figure 1:
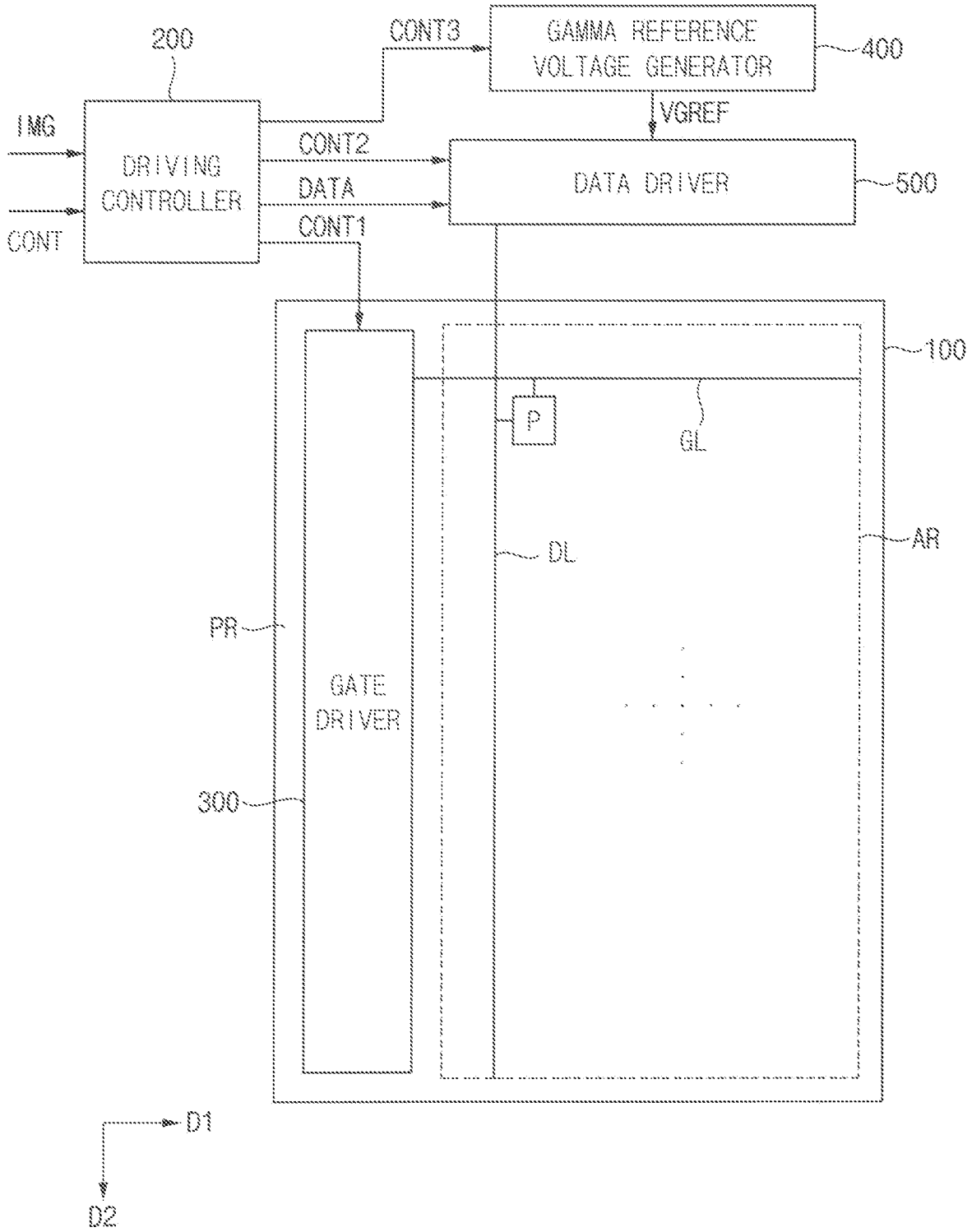
FIG. 1 is a block diagram illustrating a display apparatus according to some embodiments of the present disclosure.

FIG. 1 is a block diagram illustrating a display apparatus according to some embodiments of the present disclosure.

Referring to FIG. 1, the display apparatus includes a display panel 100 and a display panel driver. The display panel driver includes a driving controller 200, a gate driver 300, a gamma reference voltage generator 400 and a data driver 500. The display apparatus may further include a camera. The camera may be located under the display panel 100.

For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called to a timing controller embedded data driver (TED).

The display panel 100 has a display region AR on which images are displayed and a peripheral region PR adjacent to the display region AR.

The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus. The input image data IMG may include red image data, green image data, and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be integrated on the peripheral region PR of the display panel 100. For example, the gate driver 300 may be mounted on the peripheral region PR of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

According to some embodiments, the gamma reference voltage generator 400 may be located in the driving controller 200, or in the data driver 500. For example, the gamma reference voltage generator 400 and the data driver 500 may be integrally formed.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL. For example, the data driver 500 may be integrated on the peripheral region PR of the display panel 100. For example, the data driver 500 may be mounted on the peripheral region PR of the display panel 100.

Figure 2:
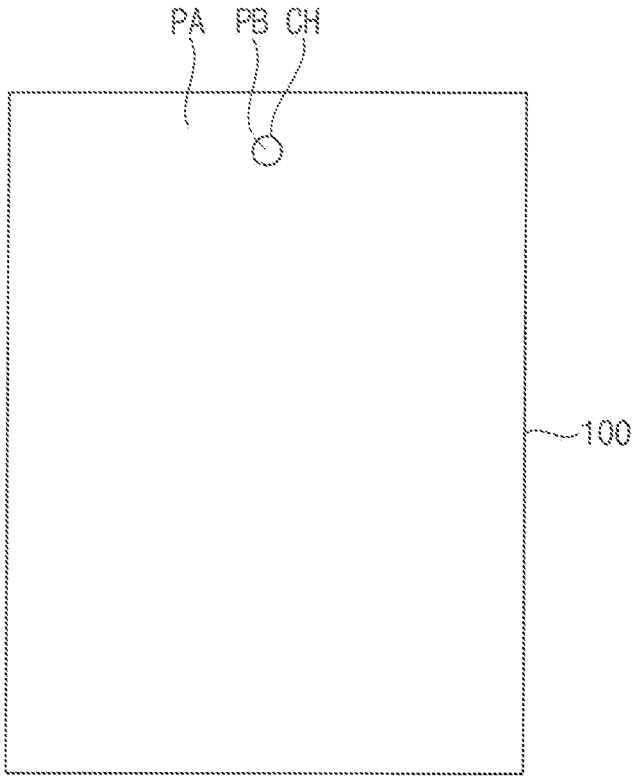
FIG. 2 is a conceptual diagram illustrating an upper surface of a display panel of FIG. 1 according to some embodiments of the present disclosure.
Figure 3A:
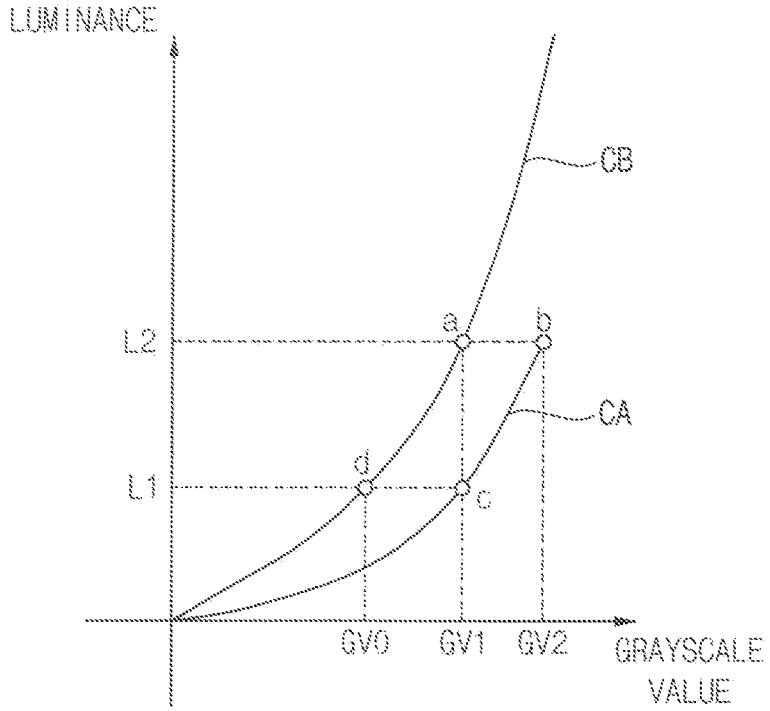
FIGS. 3A and 3B are graphs illustrating a luminance difference between a normal area and a camera area according to some embodiments of the present disclosure.
Figure 3B:
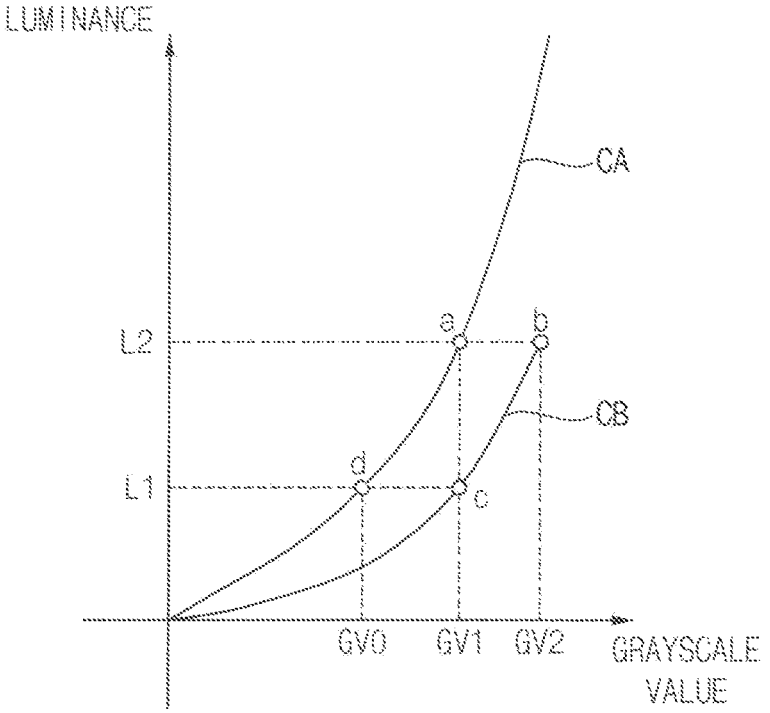

FIG. 2 is a conceptual diagram illustrating an upper surface of the display panel 100 of FIG. 1. FIGS. 3A and 3B are graphs illustrating a luminance difference between a normal area PA and a camera area PB.

Referring to FIGS. 1 and 2, the camera may be located under the display panel 100. The display panel 100 may include a normal area PA (a first area) where the camera is not located and a camera area PB (a second area) where the camera is located. A portion of the upper surface of the display panel 100 corresponding to a periphery of the camera area PB where the camera is located may be referred to as a camera hole CH. Herein, the camera hole CH may not mean that a hole is actually formed. The camera hole CH may mean a boundary line outside the camera area PB.

Pixels may be located in the normal area PA and the camera area PB. The normal area PA and the camera area PB may have different pixel structures. In the camera area PB, a transmission window may be formed between the pixels such that the camera located under the display panel 100 is capable of capturing a front side of the display panel 100.

If a pixel of the normal area PA and a pixel of the camera area PB have the same size and the same driving force, a luminance of a unit area of the normal area PA may be greater than a luminance of a unit area of the camera area PB. However, a transistor of the pixel in the camera area PB may be manufactured to be greater than a transistor of the pixel in the normal area PA to compensate the luminance of the camera area PB. In this case, the luminance of the unit area of the camera area PB may be greater than the luminance of the unit area of the normal area PA.

As explained above, the normal area PA and the camera area PB have different pixel structures so that the normal area PA and the camera area PB may represent different luminances for the same grayscale value. In a manufacturing step of the display apparatus, a front surface of the display panel 100 may be captured using an external industrial camera to compensate a luminance difference between the normal area PA and the camera area PB. However, even with this compensation, as time passes, the luminance difference between the normal area PA and the camera area PB may occur again due to the different pixel structures and the different driving currents between the normal area PA and the camera area PB.

In FIG. 3A, for example, the luminance of the camera area PB may be greater than the luminance of the normal area PA for the same grayscale value. The luminance of the camera area PB is represented to CB and the luminance of the normal area PA is represented to CA.

For a grayscale value of GV1, the camera area PB may have a luminance of L2 and the normal area PA may have a luminance of L1. To match the luminance of the normal area PA and the camera area PB, a compensation grayscale value of the camera area PB may be determined to GV0 for the input grayscale value of GV1 of the camera area PB such that the luminance of the camera area PB is decreased from L2 to L1 (decreased from a to d on the curve of CB).

Alternatively, to match the luminance of the normal area PA and the camera area PB, a compensation grayscale value of the normal area PA may be determined to GV2 for the input grayscale value of GV1 of the normal area PA such that the luminance of the normal area PA is increased from L1 to L2 (increased from c to b on the curve of CA).

In FIG. 3B, for example, the luminance of the normal area PA may be greater than the luminance of the camera area PB for the same grayscale value. The luminance of the camera area PB is represented to CB and the luminance of the normal area PA is represented to CA.

For a grayscale value of GV1, the normal area PA may have a luminance of L2 and the camera area PB may have a luminance of L1. To match the luminance of the normal area PA and the camera area PB, a compensation grayscale value of the normal area PA may be determined to GV0 for the input grayscale value of GV1 of the normal area PA such that the luminance of the normal area PA is decreased from L2 to L1 (decreased from a to d on the curve of CA).

Alternatively, to match the luminance of the normal area PA and the camera area PB, a compensation grayscale value of the camera area PB may be determined to GV2 for the input grayscale value of GV1 of the camera area PB such that the luminance of the camera area PB is increased from L1 to L2 (increased from c to b on the curve of CB).

When the above explained compensation is performed, the normal area PA and the camera area PB may receive different driving currents to represent the same grayscale value. When the above explained compensation is repeated, a degree of deterioration of a light emitting element of a pixel of the normal area PA may become different from a degree of deterioration of a light emitting element of a pixel of the camera area PB. Thus, after the one-time compensation of the luminance difference between the normal area PA and the camera area PB in the manufacturing step, as time passes, the luminance difference between the normal area PA and the camera area PB may occur again.

Figure 4:
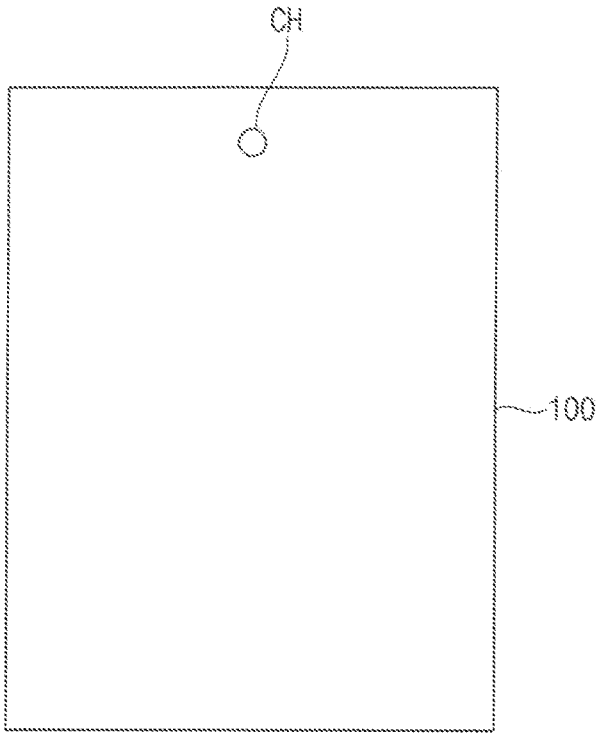
FIG. 4 is a conceptual diagram illustrating the upper surface of the display panel of FIG. 1 according to some embodiments of the present disclosure.
Figure 5:
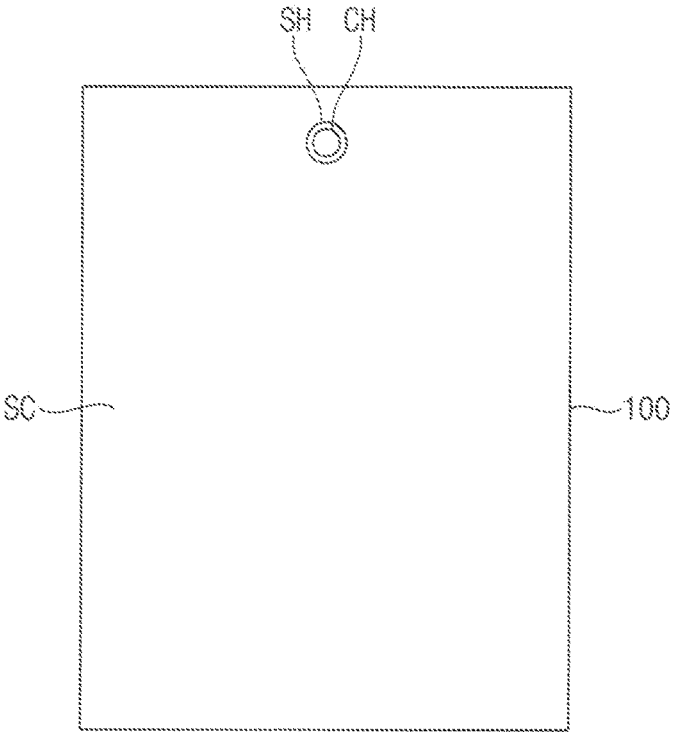
FIG. 5 is a conceptual diagram illustrating a lower surface of the display panel of FIG. 1 according to some embodiments of the present disclosure.
Figure 6:
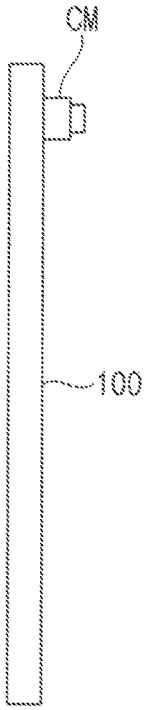
FIG. 6 is a conceptual diagram illustrating a side surface of the display panel of FIG. 1 and a camera according to some embodiments of the present disclosure.

FIG. 4 is a conceptual diagram illustrating the upper surface of the display panel 100 of FIG. 1. FIG. 5 is a conceptual diagram illustrating a lower surface of the display panel 100 of FIG. 1. FIG. 6 is a conceptual diagram illustrating a side surface of the display panel 100 of FIG. 1 and a camera CM.

Referring to FIGS. 1 to 6, the display panel includes a first area (the normal area) having a first pixel structure and a second area (the camera area) having a second pixel structure different from the first pixel structure. The camera CM may be located under the display panel 100. The camera CM may be arranged to correspond to the second area (the camera area).

In FIG. 4, the first area may mean an outside of the camera hole CH and the second area may mean an inside of the camera hole CH.

In FIG. 5, a protect layer SC is located on the lower surface of the display panel 100 to block light incident toward the lower surface of the display panel 100. The lower surface of the display panel 100 may include a screen hole SH where the protect layer SC does not correspond to the second area.

For example, a size of the screen hole SH may be greater than a size of the second area (the inside of the camera hole CH).

A range where the camera CM can capture an image may be defined by the size of the screen hole SH. The camera CM may capture an inner area of the screen hole SH from the lower surface of the display panel 100.

Figure 7A:
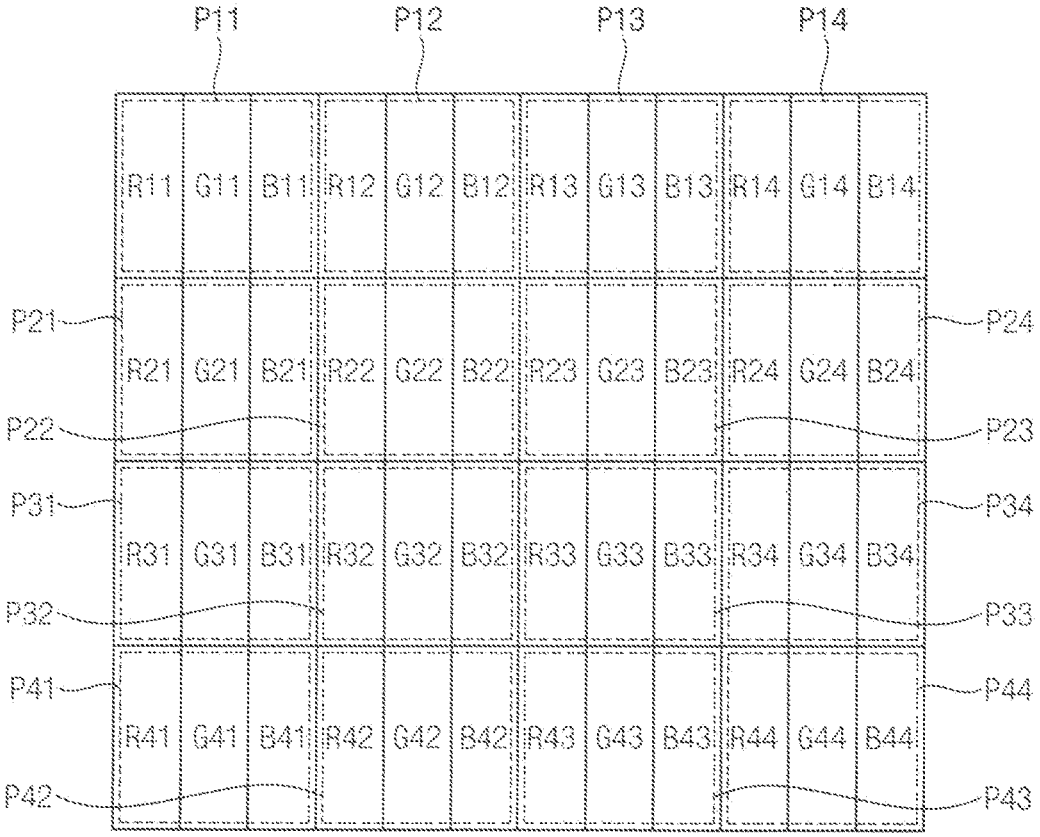
FIG. 7A is a conceptual diagram illustrating a pixel structure of a first area of the display panel of FIG. 1 according to some embodiments of the present disclosure.
Figure 7B:
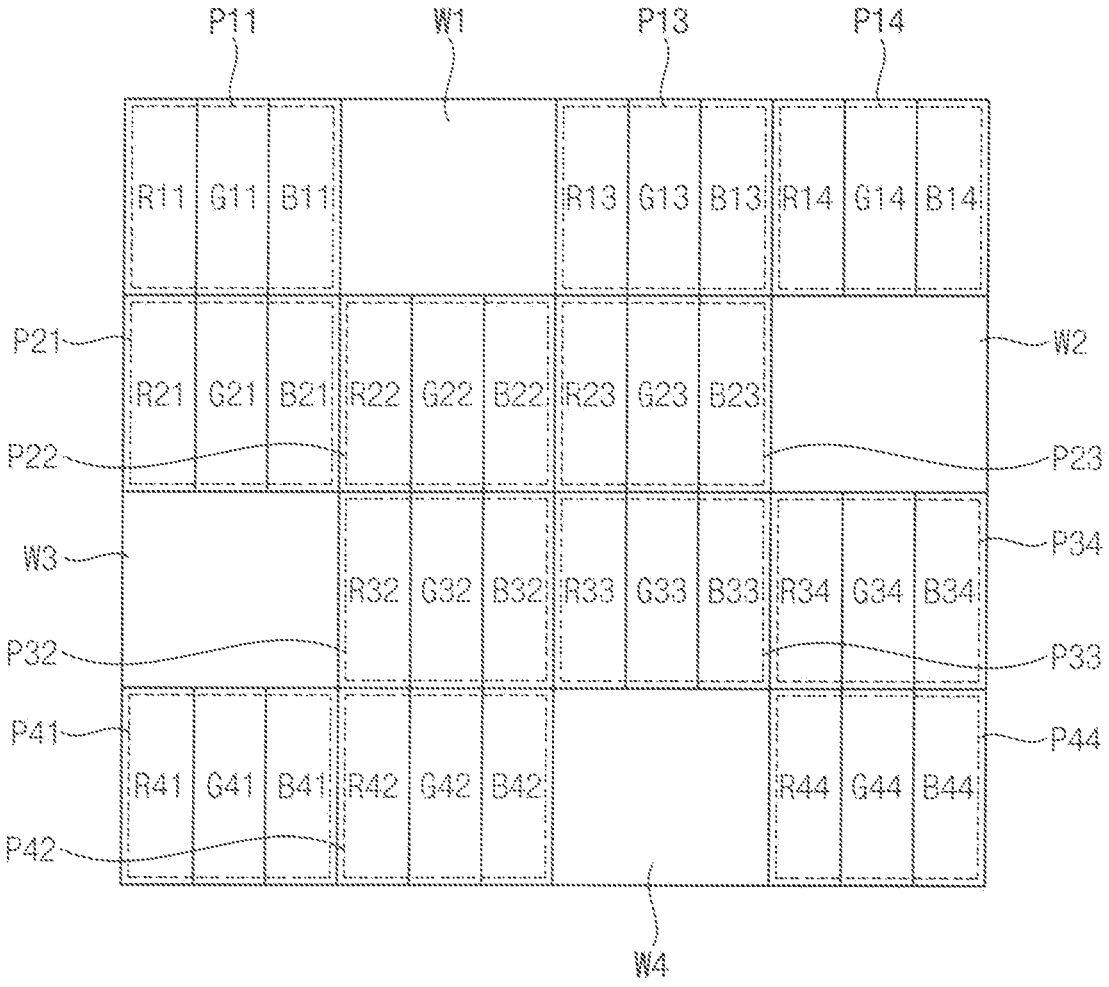
FIG. 7B is a conceptual diagram illustrating an example of a pixel structure of a second area of the display panel of FIG. 1 according to some embodiments of the present disclosure.

FIG. 7A is a conceptual diagram illustrating the first pixel structure of the first area of the display panel 100 of FIG. 1. FIG. 7B is a conceptual diagram illustrating an example of the second pixel structure of the second area of the display panel 100 of FIG. 1.

Referring to FIGS. 1 to 7B, a pixel density of the first pixel structure of the first area (the normal area) may be greater than a pixel density of the second pixel structure of the second area (the camera area).

As shown in FIG. 7A, the first pixel structure may include four pixels (e.g. P11, P12, P21 and P22) arranged in two rows and two columns. As shown in FIG. 7B, the second pixel structure may include three pixels P11, P21 and P22 and one transmission window W1 arranged in two rows and two columns. For example, each pixel P11, P12, P21 and P22 may include a first color subpixel R11, R12, R21 and R22, a second color subpixel G11, G12, G21 and G22 and a third color subpixel B11, B12, B21 and B22.

As shown in FIG. 7A, the first pixel structure may further include other four pixels (e.g. P13, P14, P23 and P24) arranged in two rows and two columns. As shown in FIG. 7B, the second pixel structure may further include other three pixels P13, P14 and P23 and one transmission window W2 arranged in two rows and two columns.

As shown in FIG. 7A, the first pixel structure may further include other four pixels (e.g. P31, P32, P41 and P42) arranged in two rows and two columns. As shown in FIG. 7B, the second pixel structure may further include other three pixels P32, P41 and P42 and one transmission window W3 arranged in two rows and two columns.

As shown in FIG. 7A, the first pixel structure may further include other four pixels (e.g. P33, P34, P43 and P44) arranged in two rows and two columns. As shown in FIG. 7B, the second pixel structure may further include other three pixels P33, P34 and P44 and one transmission window W4 arranged in two rows and two columns.

When three pixels and one transmission window arranged in two rows and two columns form a pixel group in FIG. 7B, a position of the transmission window in a pixel group may be different from a position of the transmission window in an adjacent pixel group. For example, a position of the transmission window W1 in a first pixel group P11, P21, P22 and W1 may be different from a position of the transmission window W2 in a second pixel group P13, P14, P23 and W2. As shown in FIG. 7B, the position of the transmission window W1 in the first pixel group P11, P21, P22 and W1 is in a first quadrant and the position of the transmission window W2 in a second pixel group P13, P14, P23 and W2 is in a fourth quadrant.

Figure 7C:
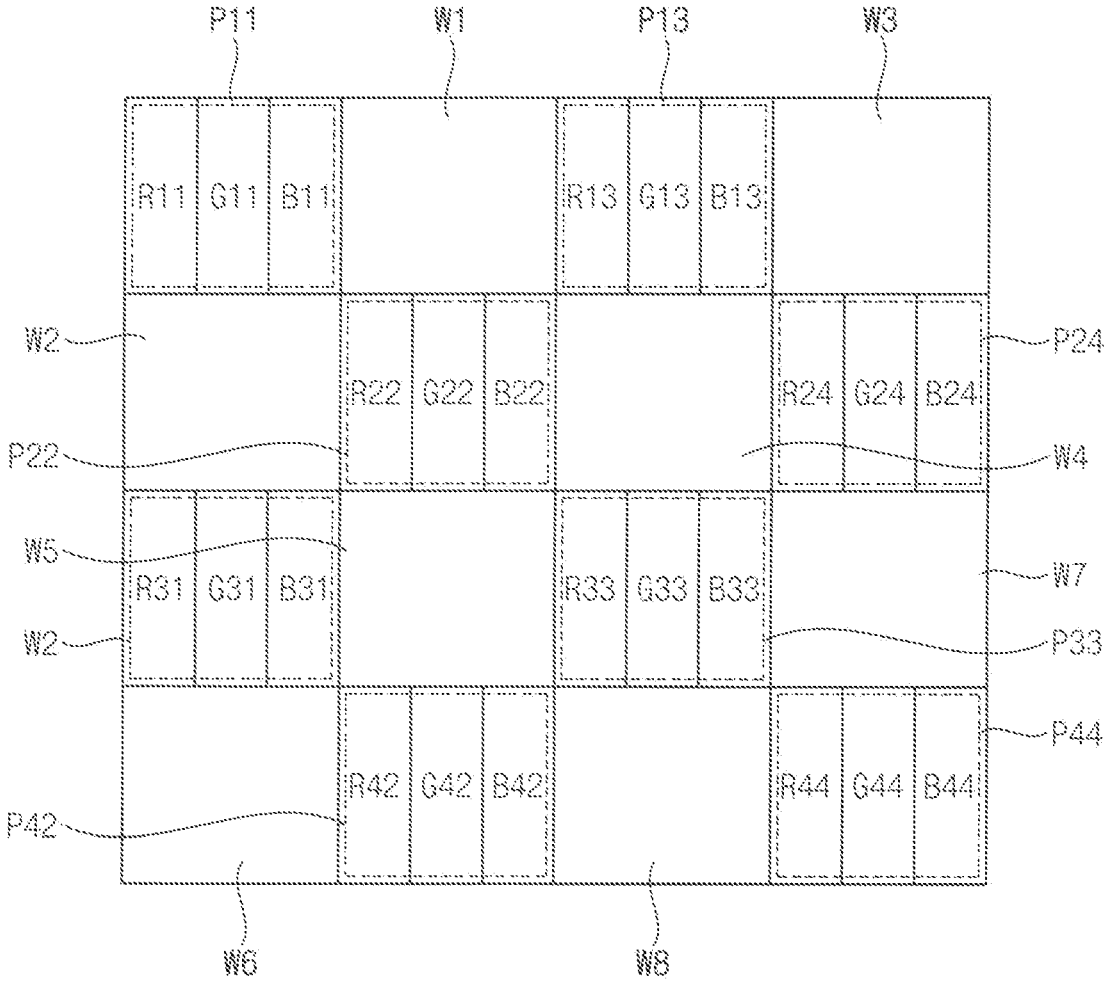
FIG. 7C is a conceptual diagram illustrating an example of the pixel structure of the second area of the display panel of FIG. 1 according to some embodiments of the present disclosure.

FIG. 7C is a conceptual diagram illustrating an example of the pixel structure of the second area of the display panel 100 of FIG. 1.

Referring to FIGS. 7A and 7C, a pixel density of the first pixel structure of the first area (the normal area) may be greater than a pixel density of the second pixel structure of the second area (the camera area).

As shown in FIG. 7A, the first pixel structure may include four pixels (e.g. P11, P12, P21 and P22) arranged in two rows and two columns. As shown in FIG. 7C, the second pixel structure may include two pixels P11 and P22 and two transmission windows W1 and W2 arranged in two rows and two columns.

As shown in FIG. 7A, the first pixel structure may further include other four pixels (e.g. P13, P14, P23 and P24) arranged in two rows and two columns. As shown in FIG. 7C, the second pixel structure may further include other two pixels P13 and P24 and two transmission windows W3 and W4 arranged in two rows and two columns.

As shown in FIG. 7A, the first pixel structure may further include other four pixels (e.g. P31, P32, P41 and P42) arranged in two rows and two columns. As shown in FIG. 7C, the second pixel structure may further include other two pixels P31 and P42 and two transmission windows W5 and W6 arranged in two rows and two columns.

As shown in FIG. 7A, the first pixel structure may further include other four pixels (e.g. P33, P34, P43 and P44) arranged in two rows and two columns. As shown in FIG. 7C, the second pixel structure may further include other three pixels P33 and P44 and two transmission windows W7 and W8 arranged in two rows and two columns.

Figure 8:
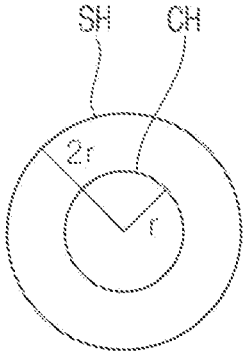
FIG. 8 is a conceptual diagram illustrating the second area and a screen hole of the display panel of FIG. 1 according to some embodiments of the present disclosure.
Figure 9A:
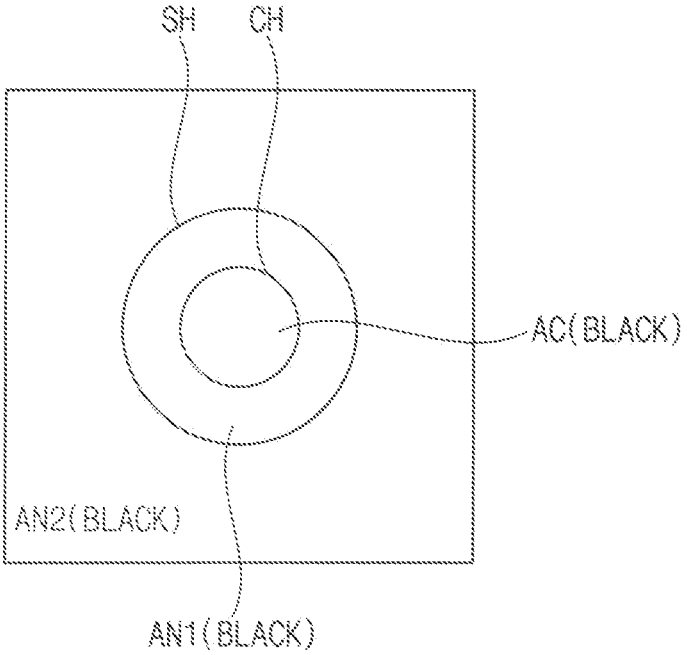
FIGS. 9A to 9C are conceptual diagrams illustrating a method of determining a luminance of the first area of FIG. 2 and a luminance of the second area of FIG. 2 according to some embodiments of the present disclosure.
Figure 9B:
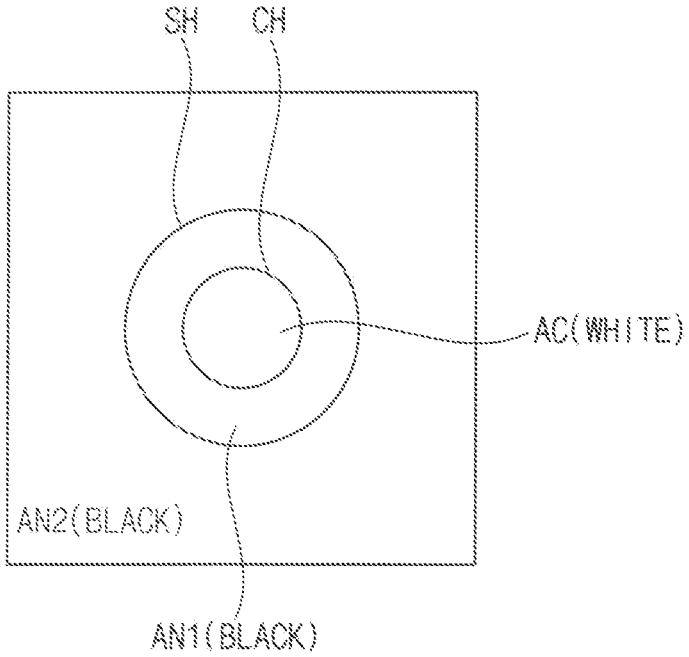
Figure 9C:
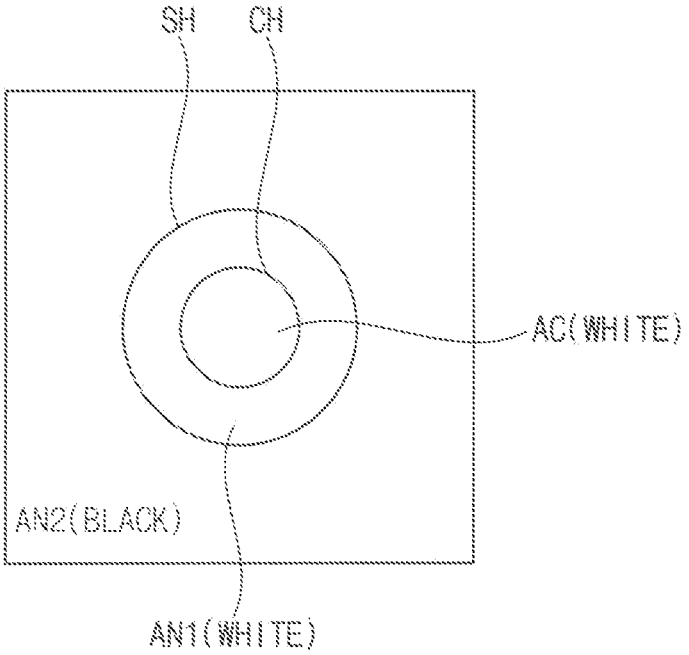
Figure 10:
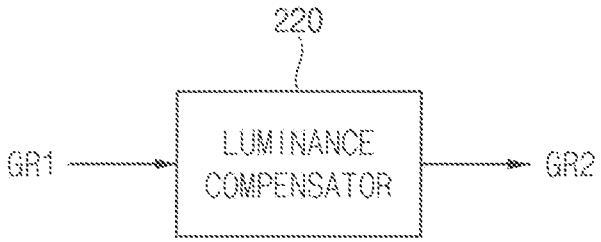
FIG. 10 is a block diagram illustrating a luminance compensator of a driving controller of FIG. 1 according to some embodiments of the present disclosure.

FIG. 8 is a conceptual diagram illustrating the second area (inside CH) and a screen hole SH of the display panel 100 of FIG. 1. FIGS. 9A to 9C are conceptual diagrams illustrating a method of determining a luminance of the first area of FIG. 2 and a luminance of the second area of FIG. 2. FIG. 10 is a block diagram illustrating a luminance compensator 220 of the driving controller 200 of FIG. 1.

Referring to FIGS. 1 to 10, the camera CM may obtain captured data by capturing an image displayed in a compensation display area (inside SH in the present embodiments) surrounding the second area (inside CH). According to some embodiments, for example, the size of the compensation display area may be same as the size of the screen hole SH.

In addition, according to some embodiments, the screen hole SH and an outline CH of the second area may be concentric and a radius 2*r* of the screen hole SH may be twice of a radius r of the outline CH of the second area.

The driving controller 200 may include the luminance compensator 220 determining the luminance of the first area (the normal area) and the second area (the camera area) using the captured data captured by the camera CM and compensating image data applied to the display panel 100.

The luminance compensator 220 may receive an input grayscale value GR1 and generate a compensated grayscale value GR2 for compensating the luminance. The luminance compensator 220 may generate the compensated grayscale value GR2 based on the luminance of the first area and the luminance of the second area determined using the captured data of the display panel 100 captured by the camera CM.

For example, the luminance of the first area and the luminance of the second area may be determined at a power-off period of the display apparatus. Alternatively, the luminance of the first area and the luminance of the second area may be determined at a power-on period of the display apparatus.

In FIG. 9A, the camera CM may obtain the captured data by capturing an image displayed in the compensation display area (inside SH) surrounding the second area. The compensation display area (inside SH) includes all of the second area (inside CH, the camera area) and a portion of the first area (the normal area). The camera CM may obtain first captured data when a black image is displayed in the entire compensation display area (inside SH) AC and AN1.

In FIG. 9B, the camera CM may obtain second captured data when the black image is displayed in the first area (the normal area) AN1 of the compensation display area (inside SH) and a white image is displayed in the second area (the camera area) AC of the compensation display area (inside SH).

The luminance compensator 220 may determine the luminance of the second area by subtracting the first captured data from the second captured data.

When the luminance of the first captured data is LUM1, the luminance of the second captured data is LUM2, the second area (inside CH) has a circular shape and a radius of the second area (inside CH) is r, a luminance of a unit area of the second area (the camera area, inside CH) may be $(LUM2-LUM1)/\pi r^2$.

The luminance LUM1 of the first captured data may mean a default luminance value generated when the black image is displayed. A net luminance of the camera area (inside CH) may be obtained by subtracting the luminance LUM1 of the first captured data from the luminance LUM2 of the second captured data. The luminance of the unit area of the camera area (inside CH) may be obtained by dividing the net luminance of the camera area (inside CH) by $\pi r^2$, which is the area of the camera area (inside CH).

In FIG. 9C, the camera CM may obtain third captured data when the white image is displayed in the first area (the normal area) AN1 of the compensation display area (inside SH) and the white image is displayed in the second area (the camera area) AC of the compensation display area (inside SH).

In FIGS. 9A to 9C, for example, the black image may be displayed outside the compensation display area (outside SH) AN2. According to some embodiments, the outside of the compensation display area (outside SH) AN2 is an outside of the screen hole SH so that the outside of the compensation display area may be an area which is not captured by the camera CM. Thus, which image is displayed outside the compensation display area (outside SH) AN2 may have little effect on the compensation.

The luminance compensator 220 may determine the luminance of the first area by subtracting the second captured data from the third captured data.

When the luminance of the second captured data is LUM2, the luminance of the third captured data is LUM3, the compensation display area (inside SH) has a circular shape, a radius of the compensation display area (inside SH) is 2r, the second area (inside CH) has a circular shape and a radius of the second area (inside CH) is r, a luminance of a unit area of the first area (the normal area) may be $(LUM3-LUM2)/3\pi r^2$.

When subtracting the second captured data from the third captured data, the luminance of the area AN1 having a donut-shaped shape excluding the inside of CH among the inside of SH may be obtained. The luminance of the unit area of the normal area may be obtained by dividing the luminance of the area AN1 having a donut-shaped shape excluding the inside of CH among the inside of SH by $3\pi r^2$, which is the area of the donut-shaped shape.

Figure 11:
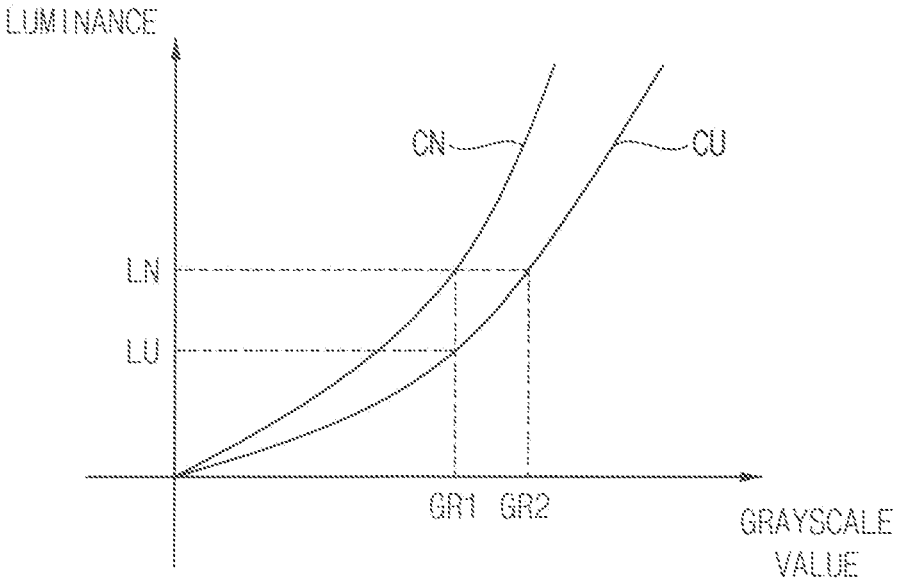
FIG. 11 is a graph illustrating an operation of the luminance compensator of FIG. 10 according to some embodiments of the present disclosure.
Figures 12, 13:
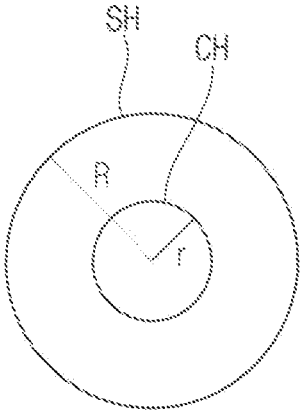
FIG. 12 is a conceptual diagram illustrating the operation of the luminance compensator of FIG. 10 according to some embodiments of the present disclosure.
FIG. 13 is a conceptual diagram illustrating a second area and a screen hole of a display panel of a display apparatus according to some embodiments of the present disclosure.

FIG. 11 is a graph illustrating an operation of the luminance compensator 220 of FIG. 10. FIG. 12 is a conceptual diagram illustrating the operation of the luminance compensator 220 of FIG. 10.

Referring to FIGS. 1 to 12, for example, the luminance compensator 220 may receive first grayscale data GR1 corresponding to the second area (the camera area) and may generate second grayscale data GR2 such that the luminance LU of the second area (the camera area) becomes same as the luminance LN of the first area (the normal area).

In FIG. 11, for example, the luminance LN of the normal area may be measured to be greater than the luminance LU of the camera area. In FIG. 11, CN is a curve representing the luminance LN of the normal area and CU is a curve representing the luminance LU of the camera area. The luminance compensator 220 may receive the first grayscale data GR1 corresponding to the second area (the camera area) and may compensate the first grayscale data GR1 to the second grayscale data GR2 such that the luminance LU of the second area (the camera area) becomes same as the luminance LN of the first area (the normal area).

Alternatively, the luminance compensator 220 may receive first grayscale data corresponding to the first area (the normal area) and may compensate the first grayscale data to second grayscale data such that the luminance of the first area (the normal area) becomes same as the luminance of the second area (the camera area).

In FIG. 12, the luminance compensator 220 may measure LN which is the luminance for each grayscale value of the first area and LUMAX which is a maximum luminance of the second area and may determine a grayscale value GMAX corresponding to LUMAX based on a reference of the first area. In FIG. 12, GMAX may be 350-grayscales G350. When a luminance of the first area for a grayscale value X is a LNX, the second grayscale data for the grayscale value X is GX and a gamma value of the display panel is γ, $GX=GMAX(LNX/LUMAX)^{1/\gamma}$ may be satisfied.

For example, when a luminance LN of the normal area for one-grayscale G1 is a LN1, the second grayscale data for the one-grayscale G1 is GX1 and the gamma value of the display panel is γ, $GX1=GMAX(LN1/LUMAX)^{11}V$ may be satisfied. The luminance of the camera area corresponding to GX1 may be LU1.

For example, when a luminance LN of the normal area for 23-grayscales G23 is a LN23, the second grayscale data for the 23-grayscales G23 is GX23 and the gamma value of the display panel is γ, $GX23=GMAX(LN23/LUMAX)^{1/\gamma}$ may be satisfied. The luminance of the camera area corresponding to GX23 may be LU23.

According to some embodiments of the present disclosure, the luminance compensator 220 may store the luminances LN of the normal area only for representative grayscale values and intermediate data between the representative grayscale values may be generated by an interpolation method. When the luminance compensator 220 stores the luminances LN of the normal area only for the representative grayscale values, a size of a memory may be reduced and a compensation time may be reduced. Although the representative grayscale values include G1, G11, G23, G35, G51, G87, G151, G203 and G255 in FIG. 12, embodiments according to the present disclosure may not be limited thereto.

According to some embodiments, the luminance difference between the normal area of the display panel 100 where the camera CM is not located and the camera area of the display panel 100 where the camera CM is located may be compensated using the data obtained by the camera CM located in the display apparatus.

When the luminance difference of the display panel 100 is compensated using the built-in camera CM, the luminance difference of the display panel 100 may be compensated in real time (e.g., during the power-on period or the power-off period) without an additional compensation device. Thus, the display quality of the display apparatus may be enhanced.

FIG. 13 is a conceptual diagram illustrating a second area (inside CH) and a screen hole SH of a display panel 100 of a display apparatus according to some embodiments of the present disclosure.

The display apparatus according to the present embodiments is substantially the same as the display apparatus of the previous embodiments described with respect to FIGS. 1 to 12 except for the size of the screen hole. Thus, the same reference numerals will be used to refer to the same or like parts as those described in the previous embodiments described with respect to FIGS. 1 to 12 and some repetitive explanation concerning the above elements may be omitted.

Referring to FIGS. 1 to 7C and 9A to 13, the camera CM may obtain captured data by capturing an image displayed in a compensation display area (inside SH in the present embodiments) surrounding the second area (inside CH). According to some embodiments, for example, the size of the compensation display area may be same as the size of the screen hole SH.

In addition, according to some embodiments, the screen hole SH and an outline CH of the second area may be concentric and a radius R of the screen hole SH may be twice of a radius r of the outline CH of the second area.

Although the radius R of the screen hole SH is twice of the radius r of the outline CH of the second area in FIG. 8, the present inventive concept may be generalized to various cases in which the radius R of the screen hole SH is greater than the radius r of the outline CH of the second area in the present embodiments.

For example, the radius R of the screen hole SH may be three times of the radius r of the outline CH of the second area or the radius R of the screen hole SH may be 1.5 times of the radius r of the outline CH of the second area.

The driving controller 200 may include the luminance compensator 220 determining the luminance of the first area (the normal area) and the second area (the camera area) using the captured data captured by the camera CM and compensating image data applied to the display panel 100.

The luminance compensator 220 may receive an input grayscale value GR1 and generate a compensated grayscale value GR2 for compensating the luminance. The luminance compensator 220 may generate the compensated grayscale value GR2 based on the luminance of the first area and the luminance of the second area determined using the captured data of the display panel 100 captured by the camera CM.

Referring again to FIG. 9A, the camera CM may obtain the captured data by capturing an image displayed in the compensation display area (inside SH) surrounding the second area. The compensation display area (inside SH) includes all of the second area (inside CH, the camera area) and a portion of the first area (the normal area). The camera CM may obtain first captured data when a black image is displayed in the entire compensation display area (inside SH) AC and AN1.

Referring again to FIG. 9B, the camera CM may obtain second captured data when the black image is displayed in the first area (the normal area) AN1 of the compensation display area (inside SH) and a white image is displayed in the second area (the camera area) AC of the compensation display area (inside SH).

The luminance compensator 220 may determine the luminance of the second area by subtracting the first captured data from the second captured data.

When the luminance of the first captured data is LUM1, the luminance of the second captured data is LUM2, the second area (inside CH) has a circular shape and a radius of the second area (inside CH) is r, a luminance of a unit area of the second area (the camera area, inside CH) may be $(LUM2-LUM1)/\pi r^2$.

Referring again to FIG. 9C, the camera CM may obtain third captured data when the white image is displayed in the first area (the normal area) AN1 of the compensation display area (inside SH) and the white image is displayed in the second area (the camera area) AC of the compensation display area (inside SH).

The luminance compensator 220 may determine the luminance of the first area by subtracting the second captured data from the third captured data.

When the luminance of the second captured data is LUM2, the luminance of the third captured data is LUM3, the compensation display area (inside SH) has a circular shape, a radius of the compensation display area (inside SH) is R, the second area (inside CH) has a circular shape and a radius of the second area (inside CH) is r, a luminance of a unit area of the first area (the normal area) may be $(LUM3-LUM2)/\pi(R^2-r^2)$.

According to some embodiments, the luminance difference between the normal area of the display panel 100 where the camera CM is not located and the camera area of the display panel 100 where the camera CM is located may be compensated using the data obtained by the camera CM located in the display apparatus.

When the luminance difference of the display panel 100 is compensated using the built-in camera CM, the luminance difference of the display panel 100 may be compensated in real time (e.g. during the power-on period or the power-off period) without an additional compensation device. Thus, the display quality of the display apparatus may be enhanced.

Figure 14A:
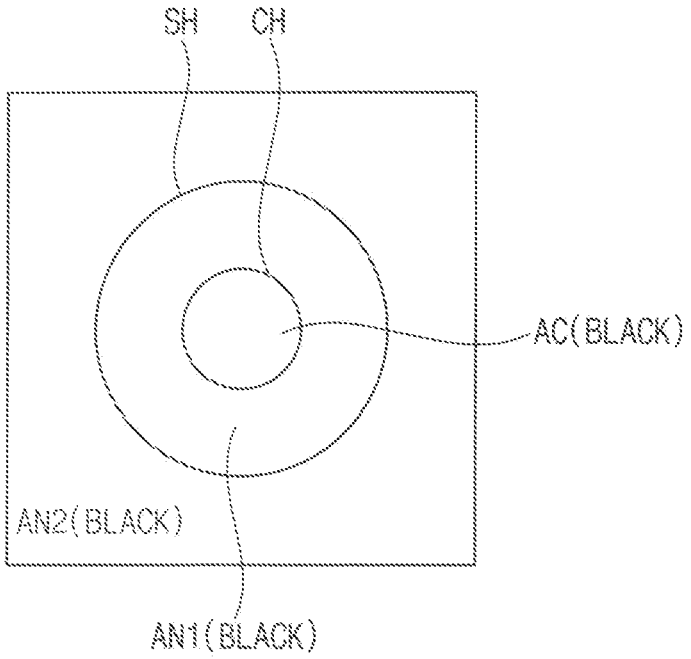
FIGS. 14A to 14C are conceptual diagrams illustrating a method of determining luminances of a first area and a second area of a display panel of a display apparatus according to some embodiments of the present disclosure.
Figure 14B:
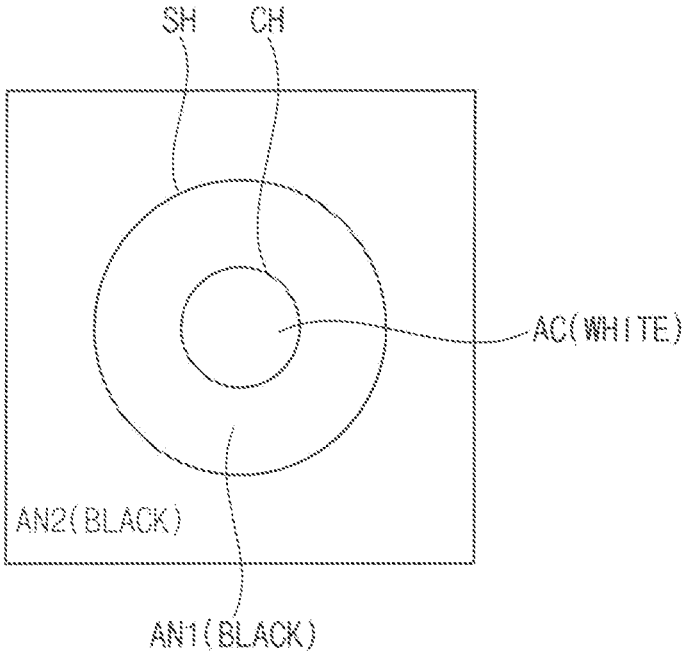
Figure 14C:
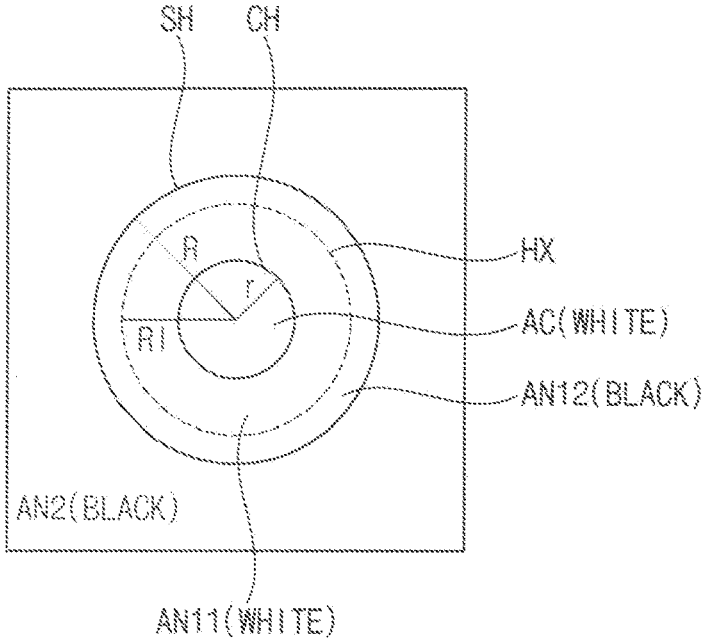

FIGS. 14A to 14C are conceptual diagrams illustrating a method of determining luminances of a first area and a second area of a display panel 100 of a display apparatus according to some embodiments of the present disclosure.

The display apparatus according to the present embodiments are substantially the same as the display apparatus of the previous embodiments described with respect to FIGS. 1 to 12 except that the size of the screen hole is not same as the size of the compensation display area. Thus, the same reference numerals will be used to refer to the same or like parts as those described in the previous embodiments described with respect to FIGS. 1 to 12 and some repetitive explanation concerning the above elements may be omitted.

Referring to FIGS. 1 to 7C and 10 to 14C, the camera CM may obtain captured data by capturing an image displayed in a compensation display area (inside HX in the present embodiments) surrounding the second area (inside CH). According to some embodiments, for example, the size of the compensation display area (inside HX) may be less than the size of the screen hole SH. The screen hole SH is an area defined by the protect layer SC. To obtain the luminance of the unit area of the normal area, it is not necessary to display the white image in an area same as the screen hole SH. Thus, to obtain the luminance of the unit area of the normal area, the white image may be displayed only in the compensation display area (inside HX) which is smaller than the area inside the screen hole SH.

In FIG. 14A, the camera CM may obtain the captured data by capturing an image displayed inside the screen hole SH surrounding the second area. The screen hole includes all of the second area (inside CH, the camera area) and a portion of the first area (the normal area). The camera CM may obtain first captured data when a black image is displayed in the entire inside (AC and AN1) the screen hole SH.

In FIG. 14B, the camera CM may obtain second captured data when the black image is displayed in the first area (the normal area) AN1 inside the screen hole SH and a white image is displayed in the second area (the camera area) AC inside the screen hole SH.

The luminance compensator 220 may determine the luminance of the second area by subtracting the first captured data from the second captured data.

When the luminance of the first captured data is LUM1, the luminance of the second captured data is LUM2, the second area (inside CH) has a circular shape and a radius of the second area (inside CH) is r, a luminance of a unit area of the second area (the camera area, inside CH) may be $(LUM2-LUM1)/\pi r^2$.

As illustrated in FIG. 14C, according to some embodiments, the white image may not be displayed in the entire inside of the screen hole SH, but displayed only in the compensation display area AN11 which is smaller than the screen hole SH. The camera CM may obtain third captured data when the white image is displayed in the first area (the normal area) AN11 of the compensation display area (inside HX) and the white image is displayed in the second area (the camera area) AC of the compensation display area (inside HX). Herein, a black image may be displayed in the first area (the normal area AN12 which is inside the screen hole SH but outside the compensation display area (outside HX).

In FIGS. 14A to 14C, for example, the black image may be displayed outside AN2 the screen hole SH. According to some embodiments, the outside AN2 of the screen hole SH may be an area which is not captured by the camera CM. Thus, which image is displayed outside AN2 the screen hole SH may have little effect on the compensation.

The luminance compensator 220 may determine the luminance of the first area by subtracting the second captured data from the third captured data.

When the luminance of the second captured data is LUM2, the luminance of the third captured data is LUM3, the compensation display area (inside HX) has a circular shape, a radius of the compensation display area (inside HX)

is RI, the second area (inside CH) has a circular shape and a radius of the second area (inside CH) is r, a luminance of a unit area of the first area (the normal area) may be $(LUM3-LUM2)/\pi(R1^2-r^2)$.

When subtracting the second captured data from the third captured data, the luminance of the area AN11 having a donut-shaped shape excluding the inside of CH among the inside of HX may be obtained. The luminance of the unit area of the normal area may be obtained by dividing the luminance of the area AN11 having a donut-shaped shape excluding the inside of CH among the inside of HX by $\pi(R1^2-r^2)$, which is the area of the donut-shaped shape.

According to some embodiments, the luminance difference between the normal area of the display panel 100 where the camera CM is not located and the camera area of the display panel 100 where the camera CM is located may be compensated using the data obtained by the camera CM located in the display apparatus.

When the luminance difference of the display panel 100 is compensated using the built-in camera CM, the luminance difference of the display panel 100 may be compensated in real time (e.g. during the power-on period or the power-off period) without an additional compensation device. Thus, the display quality of the display apparatus may be enhanced.

Figure 15:
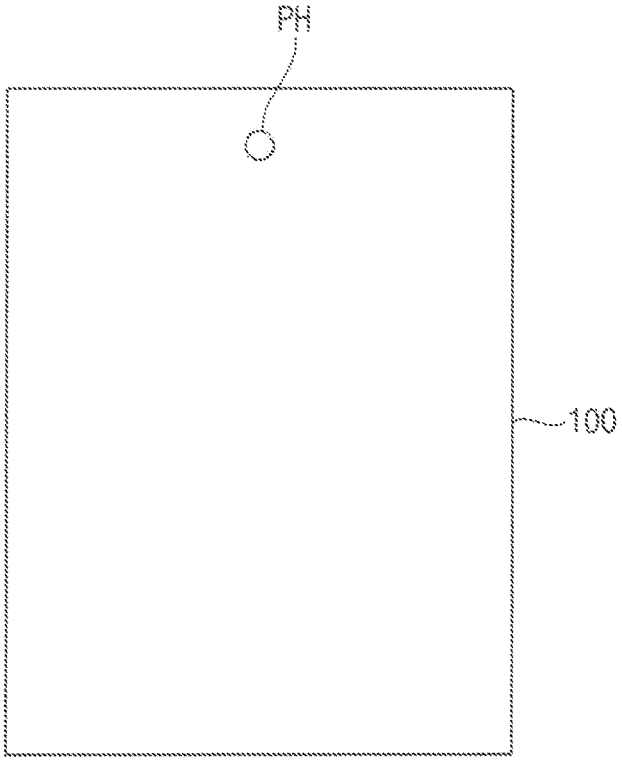
FIG. 15 is a conceptual diagram illustrating an upper surface of a display panel of a display apparatus according to some embodiments of the present disclosure.
Figure 16:
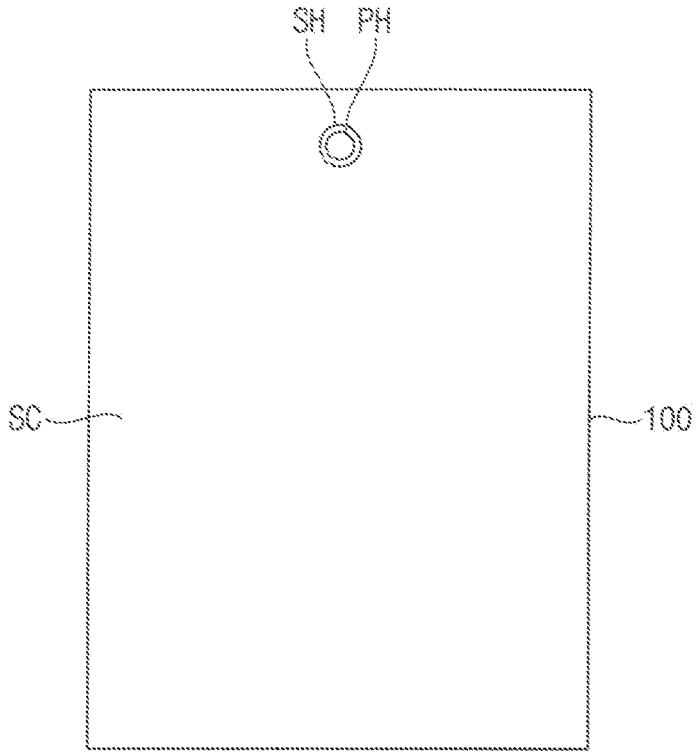
FIG. 16 is a conceptual diagram illustrating a lower surface of the display panel of FIG. 15 according to some embodiments of the present disclosure.
Figure 17:
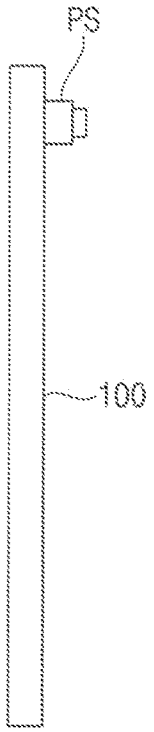
FIG. 17 is a conceptual diagram illustrating a side surface of the display panel of FIG. 15 and a photo sensor according to some embodiments of the present disclosure.

FIG. 15 is a conceptual diagram illustrating an upper surface of a display panel 100 of a display apparatus according to some embodiments of the present disclosure. FIG. 16 is a conceptual diagram illustrating a lower surface of the display panel 100 of FIG. 15. FIG. 17 is a conceptual diagram illustrating a side surface of the display panel 100 of FIG. 15 and a photo sensor PS.

The display apparatus according to the present embodiments are substantially the same as the display apparatus of the previous embodiments described with respect to FIGS. 1 to 12 except that the display apparatus does not include the camera but a photo sensor. Thus, the same reference numerals will be used to refer to the same or like parts as those described in the previous embodiments described with respect to FIGS. 1 to 12 and some repetitive explanation concerning the above elements may be omitted.

Referring to FIGS. 1, 7A to 12 and 15 to 17, the display apparatus includes a display panel 100 and a display panel driver. The display panel driver includes a driving controller 200, a gate driver 300, a gamma reference voltage generator 400 and a data driver 500. The display apparatus may further include a photo sensor PS. The photo sensor PS may be arranged under the display panel 100. The display panel 100 includes a first area (a normal area) having a first pixel structure and a second area (a sensor area) having a second pixel structure different from the first pixel structure. The photo sensor PS may be arranged under the display panel 100. The photo sensor PS may be arranged corresponding to the second area (the sensor area).

The photo sensor PS may be arranged under the display panel 100. The display panel 100 may include the normal area (the first area) where the photo sensor PS is not arranged and the sensor area (the second area) where the photo sensor PS is arranged. A portion of the upper surface of the display panel 100 corresponding to a periphery of the sensor area where the photo sensor PS is arranged may be referred to as a sensor hole PH. Herein, the sensor hole PH may not mean that a hole is actually formed. The sensor hole PH may mean a boundary line outside the sensor area.

Pixels may be arranged in the normal area and the sensor area. The normal area and the sensor area may have different pixel structures.

In FIG. 15, the first area may mean an outside of the sensor hole PH and the second area may mean an inside of the sensor hole PH.

In FIG. 16, a protect layer SC is arranged on the lower surface of the display panel 100 to block light incident toward the lower surface of the display panel 100. The lower surface of the display panel 100 may include a screen hole SH where the protect layer SC does not correspond to the second area.

For example, a size of the screen hole SH may be greater than a size of the second area (the inside of the sensor hole PH).

A range where the photo sensor PS can sense a light may be defined by the size of the screen hole SH. The photo sensor PS may sense an amount of light of the display panel 100 through the screen hole SH.

The driving controller 200 may include a luminance compensator 220 determining the luminance of the first area (the normal area) and the second area (the sensor area) using light amount data of the display panel sensed by the photo sensor PS and compensating image data applied to the display panel 100.

According to some embodiments, the luminance difference between the normal area of the display panel 100 where the photo sensor PS is not arranged and the sensor area of the display panel 100 where the photo sensor PS is arranged may be compensated using the data obtained by the photo sensor PS arranged in the display apparatus.

When the luminance difference of the display panel 100 is compensated using the built-in photo sensor PS, the luminance difference of the display panel 100 may be compensated in real time (e.g. during the power-on period or the power-off period) without an additional compensation device. Thus, the display quality of the display apparatus may be enhanced.

According to some embodiments of the present disclosure as explained above, the luminance difference between the normal area and the camera area (or the sensor area) may be compensated and the display quality of the display apparatus may be enhanced.

The foregoing is illustrative of the present inventive concept and is not to be construed as limiting thereof. Although aspects of some embodiments of the present disclosure have been described, those skilled in the art will readily appreciate that many modifications are possible in the described embodiments without materially departing from the novel teachings and characteristics of embodiments according to the present disclosure. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims, and their equivalents. Embodiments according to the present disclosure are defined by the following claims, with equivalents of the claims to be included therein.

What is claimed is:

1. A display apparatus comprising:

a display panel comprising a first area having a first pixel structure and a second area having a second pixel structure different from the first pixel structure;

a camera under the display panel and corresponding to the second area of the display panel; and a luminance compensator configured to determine a luminance of the first area and a luminance of the second area using captured data captured by the camera and configured to compensate image data applied to the display panel, wherein the camera is configured to obtain the captured data by capturing an image displayed in a compensation display area that includes the second area and a portion of the first area surrounding the second area.

2. The display apparatus of claim 1, wherein a protect layer is on a surface of the display panel, and wherein the surface of the display panel includes a screen hole where the protect layer does not correspond to the second area.

3. The display apparatus of claim 2, wherein a size of the screen hole is greater than a size of the second area.

4. The display apparatus of claim 2, wherein the camera is configured to capture an inner area of the screen hole from the surface of the display panel.

5. The display apparatus of claim 2, wherein the camera is configured to obtain first captured data in response to a black image being displayed in an entirety of the compensation display area, wherein the camera is configured to obtain second captured data in response to the black image being displayed in the first area of the compensation display area and a white image is displayed in the second area of the compensation display area, and wherein the luminance compensator is configured to determine the luminance of the second area by subtracting the first captured data from the second captured data.

6. The display apparatus of claim 5, wherein when a luminance of the first captured data is LUM1, a luminance of the second captured data is LUM2, the second area has a circular shape and a radius of the second area is r, a luminance of a unit area of the second area is $(LUM2-LUM1)/\pi r^2$.

7. The display apparatus of claim 5, wherein the camera is configured to obtain third captured data in response to the white image being displayed in the first area of the compensation display area and the white image is displayed in the second area of the compensation display area, and wherein the luminance compensator is configured to determine the luminance of the first area by subtracting the second captured data from the third captured data.

8. The display apparatus of claim 7, wherein when a luminance of the second captured data is LUM2, a luminance of the third captured data is LUM3, the compensation display area has a circular shape, a radius of the compensation display area is R, the second area has a circular shape and a radius of the second area is r, a luminance of a unit area of the first area is $(LUM3-LUM2)/\pi(R^2-r^2)$.

9. The display apparatus of claim 7, wherein a size of the compensation display area is the same as a size of the screen hole.

10. The display apparatus of claim 7, wherein a size of the compensation display area is less than a size of the screen hole and greater than a size of the second area.

11. The display apparatus of claim 1, wherein the luminance compensator is configured to receive first grayscale data corresponding to the second area and configured to compensate the first grayscale data to second grayscale data such that the luminance of the second area becomes the same as the luminance of the first area.

12. The display apparatus of claim 11, wherein the luminance compensator is configured to measure LN which is a luminance for each grayscale value of the first area and LUMAX which is a maximum luminance of the second area and configured to determine a grayscale value GMAX corresponding to the LUMAX based on a reference of the first area, wherein when the luminance of the first area for a grayscale value X is a LNX, the second grayscale data for the grayscale value X is GX and a gamma value of the display panel is γ, $GX=GMAX(LNX/LUMAX)^{1/\gamma}$ is satisfied.

13. The display apparatus of claim 1, wherein the luminance compensator is configured to receive first grayscale data corresponding to the first area and configured to compensate the first grayscale data to second grayscale data such that the luminance of the first area becomes the same as the luminance of the second area.

14. The display apparatus of claim 1, wherein a pixel density of the first pixel structure is greater than a pixel density of the second pixel structure.

15. The display apparatus of claim 14, wherein the first pixel structure comprises four pixels arranged in two rows and two columns, and wherein the second pixel structure comprises three pixels and one transmission window arranged in two rows and two columns.

16. The display apparatus of claim 14, wherein the first pixel structure comprises four pixels arranged in two rows and two columns, and wherein the second pixel structure comprises two pixels and two transmission windows arranged in two rows and two columns.

17. A display apparatus comprising:

a display panel comprising a first area having a first pixel structure and a second area having a second pixel structure different from the first pixel structure;

a photo sensor under the display panel and corresponding to the second area of the display panel; and a luminance compensator configured to determine a luminance of the first area and a luminance of the second area using light amount data of the display panel sensed by the photo sensor and configured to compensate image data applied to the display panel, wherein the photo sensor is configured to obtain the light amount data by sensing a compensation display area that includes the second area and a portion of the first area surrounding the second area.

18. A method of driving a display apparatus, the method comprising:

determining a luminance of a second area of a display panel, the display panel comprising a first area having a first pixel structure and the second area having a second pixel structure different from the first pixel structure, using a camera under the display panel and corresponding to the second area;

determining a luminance of the first area using the camera; and compensating image data applied to the display panel based on the luminance of the first area and the luminance of the second area, wherein the camera is configured to obtain the luminance by capturing an image displayed in a compensation display area that includes the second area and a portion of the first area surrounding the second area.

19. The method of claim 18, wherein the camera is configured to obtain first captured data in response to a black image being displayed in an entirety of the compensation display area, wherein the camera is configured to obtain second captured data in response to the black image being displayed in the first area of the compensation display area and a white image being displayed in the second area of the compensation display area, and wherein the luminance of the second area is determined by subtracting the first captured data from the second captured data.

20. The method of claim 19, wherein the camera is configured to obtain third captured data in response to the white image being displayed in the first area of the compensation display area and the white image being displayed in the second area of the compensation display area, and wherein the luminance of the first area is determined by subtracting the second captured data from the third captured data.

* * * * *